US008763689B2

(12) United States Patent
Heijnen

(10) Patent No.: US 8,763,689 B2
(45) Date of Patent: Jul. 1, 2014

(54) CERAMIC SCREEN

(75) Inventor: Wilhelmus Hubertus Paulus Maria Heijnen, Charlottenlund (DK)

(73) Assignee: Maersk Olie Og Gas A/S, Copenhagen K (DK)

( * ) Notice: Subject to any disclaimer, the term of this patent is extended or adjusted under 35 U.S.C. 154(b) by 10 days.

(21) Appl. No.: 11/823,578

(22) Filed: Jun. 28, 2007

(65) Prior Publication Data

US 2008/0156481 A1 Jul. 3, 2008

(30) Foreign Application Priority Data

Dec. 29, 2006 (DK) ..... 2006 01719

(51) Int. Cl.
*E03B 3/18* (2006.01)
*E03B 3/22* (2006.01)

(52) U.S. Cl.
USPC ..... 166/227; 166/205; 166/228; 166/332.1

(58) Field of Classification Search
USPC ..... 166/227, 228, 205, 381, 386, 332.1, 166/334.1, 233, 263
See application file for complete search history.

(56) References Cited

U.S. PATENT DOCUMENTS

| | | | | |
|---|---|---|---|---|
| 4,102,399 | A | 7/1978 | Harnsberger | |
| 4,856,590 | A | 8/1989 | Caillier | |
| 5,624,560 | A | 4/1997 | Voll et al. | |
| 6,012,522 | A * | 1/2000 | Donnelly et al. | 166/227 |
| 7,055,598 | B2 * | 6/2006 | Ross et al. | 166/236 |
| 7,066,252 | B2 | 6/2006 | Heijnen et al. | |
| 2003/0173075 | A1 * | 9/2003 | Morvant et al. | 166/230 |
| 2004/0035578 | A1 | 2/2004 | Ross et al. | |
| 2004/0050217 | A1 * | 3/2004 | Heijnen et al. | 81/100 |
| 2005/0086807 | A1 | 4/2005 | Richard et al. | |
| 2005/0194143 | A1 | 9/2005 | Xu et al. | |
| 2005/0239640 | A1 * | 10/2005 | Nilsson et al. | 502/202 |
| 2006/0000607 | A1 * | 1/2006 | Surjaatmadja et al. | 166/265 |
| 2006/0157256 | A1 * | 7/2006 | Hopkins et al. | 166/228 |
| 2008/0035330 | A1 * | 2/2008 | Richards | 166/228 |

FOREIGN PATENT DOCUMENTS

| | | |
|---|---|---|
| EP | 1 184 537 B1 | 11/2005 |
| GB | 2 314280 | 12/1997 |

OTHER PUBLICATIONS

"A Unique Method for Perforating, Fracturing, and Completing Horizontal Wells", A.P.Damgaard, D.S.Bangert, D.J.Murray, R.P.Rubbo, G.W.Stout; SPE Production Engineering; Feb. 1992; pp. 61-69.

* cited by examiner

*Primary Examiner* — Jennifer H Gay
*Assistant Examiner* — Elizabeth Gitlin
(74) *Attorney, Agent, or Firm* — Brinks Gilson & Lione

(57) ABSTRACT

A screen assembly for removing particulates from a fluid in a well bore said well bore being provided with a tubing for transport of fluids inside the tube, said tube being provided with sliding sleeve doors through which the fluids flow from the well bore external the tube and into the tube. The screen assembly comprises a filter arranged external the tubing and covering the sliding sleeve doors, such that the filter prevents particles above a predefined size from entering through the sliding sleeve doors: The screen assembly further comprises a supportive tube having apertures allowing well bore fluids to pass. Furthermore said filter is arranged on the inner side of said supportive tube, such that the filter is placed between the supportive tube and the tube with the sliding sleeve doors. The filter is made from ceramic material.

9 Claims, 3 Drawing Sheets

CERAMIC SCREEN

FIELD OF THE INVENTION

The present invention relates to a screen assembly for removing particulates from a fluid in a well bore, said well bore being provided with a tubing for transport of fluids inside the tube, said tube being provided with sliding sleeve doors through which the fluids flow from the well bore external the tube and into the tube, said screen assembly comprises: a filter arranged external the tubing and covering the sliding sleeve doors, such that the filter prevents particles above a predefined size from entering through the sliding sleeve doors, and further comprises a supportive tube having apertures allowing well bore fluids to pass, and furthermore said filter is arranged on the inner side of said supportive tube, such that the filter is placed between the supportive tube and the tube with the sliding sleeve doors.

BACKGROUND

When drilling wells into earth formations such as unconsolidated sandstone reservoirs for extraction of oil and gas, some means of filtering sand out of the fluid as it is drawn from the reservoir is required in order to obtain high production rates from such reservoirs. Different types of screens and filters have been applied for this purpose.

Screens may be used as filters by sizing the screen to block the flow of particles larger than a given size. Traditionally, a sieve analysis is performed on the formation sand prior to completion of the well and the formation sand particle size range is determined. A filter screen size is chosen which will block the largest e.g. fifty percent of the formation sand particle sizes.

Such screens are known from U.S. Pat. No. 5,624,560 describing a woven wire mesh arranged over a supporting body such as a metal perforated tube. Screens of sintered material for the purpose of removing sand particles from fluids in a well bore are known from US 2004/0050217 A1.

However, one problem is that these filters, such as wire wrapped steel screens, are subject to high erosion rates because the fluid flow is effectively straight through the filter material. The sand particles will exert an excessive wear on the filter material, which is often metal e.g. hardened steel.

Another problem is that the available inflow area for such filters is typically only below 10 percent of the total filter surface area, which greatly limits the maximum flow rate available from the well. Furthermore, particles will often plug openings or part of an opening in the filter material, such that the inflow area is further reduced.

BRIEF SUMMARY

The above-mentioned problems are solved by the screen assembly according to the invention where the filter is made from a ceramic material.

The purpose of this arrangement is to prevent solids production while allowing for cleaning using acids.

The advantages of the invention are that a ceramic material cannot be eroded away over time by the wear of sand particles, which is the case with steel. Furthermore, ceramic filters can be manufactured with different permeabilities and different porosities.

In the practical application of the invention a ceramic filter is installed around a sliding sleeve, creating an annular space between the ceramic filter and the sleeve allowing well bore fluids to flow in and out.

In a preferred embodiment of the invention the ceramic filter is manufactured from the material boron carbide, which offers the further advantage that it can only be eroded by pure diamonds. Furthermore, boron carbide ceramic material has a good resistance against acids, such that cleaning of the filter can be done by an acid treatment.

In a further embodiment of the invention, the ceramic filter is manufactured such that the pore size in the part of the filter facing a reservoir liner is smaller than the pore size of the filter material facing the tubing and the apertures in the sliding sleeve doors. Thereby, particles small enough to enter into the filter material, will also pass through the filter material. This has the advantage of minimizing the number of particles getting stuck inside the ceramic filter.

BRIEF DESCRIPTION OF THE DRAWINGS

The invention will now be described in further details with reference to the figures.

DETAILED DESCRIPTION OF THE PREFERRED EMBODIMENTS

Figure 1:
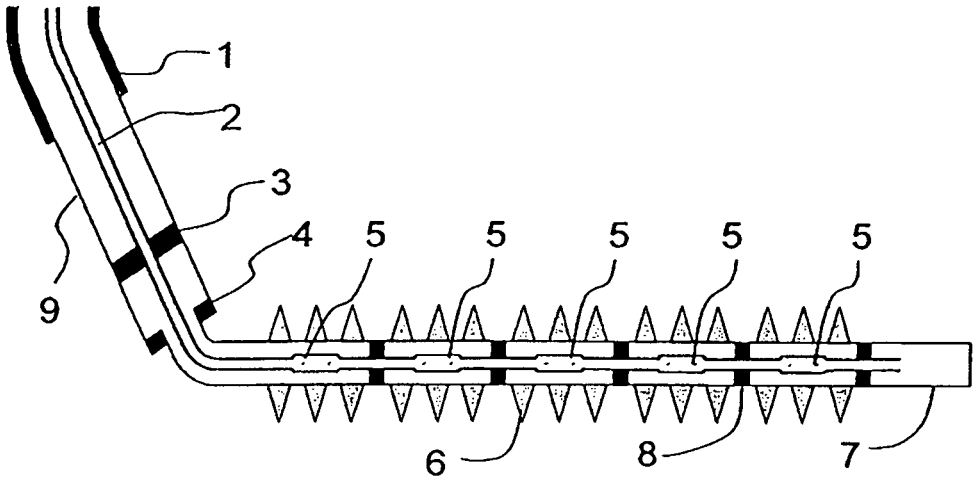
FIG. 1 illustrates a well bore.

FIG. 1 shows a schematic cross section of a well bore having a casing 1, often made from concrete, a tubing 2 running within the casing and being supported by production packers 3. A liner 9, e.g. a steel pipe, may be placed in the well bore connected with the casing 1. Such liner 9 or simply the wall of the well bore 9 will continue down to the line hanger 4 which is arranged for supporting a reservoir liner 7.

The tubing 2 is also the production string through which the oil and/or gas will flow. Packers 8 are placed with some interval distance between the reservoir liner 7 and the tubing 2. The packers 8 will divide the spacing between the reservoir liner 7 and the tubing 2 into separate sections.

In the horizontal part of the well, bore sections with sliding sleeve doors 5 (SSD) are arranged on the tubing 2. The SSD's comprise apertures in the tubing line through which the oil or gas will enter the tubing 2. These apertures can be closed or opened during operation of the well. The screens for removing sand particles from the fluid of oil and gas is normally arranged on the outside of this SSD 5. The packers 8 will prevent a flow in the space between the tubing 2 and the reservoir liner 7. Such a flow could go from the 5 zone around one SSD to a neighbouring SSD.

FIG. 1 further illustrates the perforations 6 made though the casing and into the earth formation.

Figure 2:
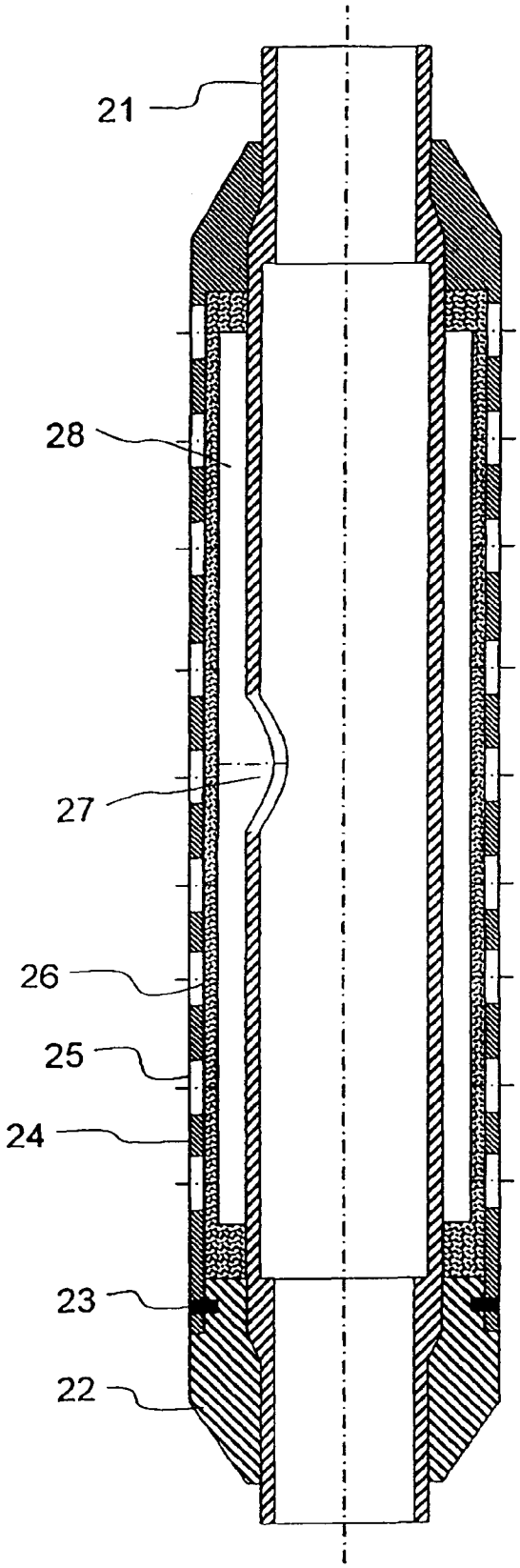
FIG. 2 illustrates a screen assembly according to an embodiment of the invention.

FIG. 2 shows a SSD 5 with a screen assembly according to an embodiment of the invention.

The element 21 comprising the sliding sleeve apertures 27 is a standard element. The element 21 with the sliding sleeve is covered by a supportive tube 24 which contains holes 25 allowing well bore fluids to enter. Inside this supportive tube 24 a ceramic filter 26 is arranged.

The filter 26 is shrinkage fitted with the supportive tube 24 by heating up the supportive tube 24, then placing it over the ceramic filter 26 and allowing the supportive tube to cool down. This shrinkage fit will cause compressive stress in the filter 26. This compressive stress improves the filter's ability to withstand the pressure exerted by the fluids flowing through the filter. Furthermore, the compressive stress prevents damage when bringing the SSD 5 into the well bore and when operating it in the well bore.

Between the ceramic filter 26 and the apertures 27 of the sliding sleeve doors is arranged an annular spacing 28, such that fluids which have penetrated the ceramic filter 26 in an area not directly opposite the apertures 27, can pass through this annular spacing 28 and into the apertures 27. The annular spacing 28 will allow the ceramic filter to have a larger active area for flow of fluids than the apertures 27 have.

FIG. 2 further shows an annular closing element 22 which closes off the element comprising the sliding sleeve in the one end. Pins 23 are used for locking the closing element 22.

The ceramic filter 26 can be made of different ceramic materials such as boron carbide, silicon carbide, silicon nitride or aluminum oxide. The ceramic material is preferably sintered.

The preferred ceramic material is boron carbide, which is one of the hardest materials known, ranking third behind diamond and cubic boron nitride. Boron carbide is a high performance abrasive material with chemical and physical properties similar to diamonds in chemical resistance and hardness. Therefore boron carbide cannot be eroded away by the sand particles. At the same time boron carbide is a material with a good resistance to the acids typically used for cleaning the screens including HF and HCl. This allows for cleaning the screen without damaging it by the use of an acid for etching away sand and other particles blocking the filter. HF and HCl are the acids typically used for this purpose, either one of the two or a mixture i.e. a so called mud acid.

A ceramic filter can be manufactured with different porosity and permeability, as well as different fluid flow properties. In this way it is possible to arrange the well bore with filters which differ in flow resistance along the longitudinal direction of the well bore.

Figure 3:
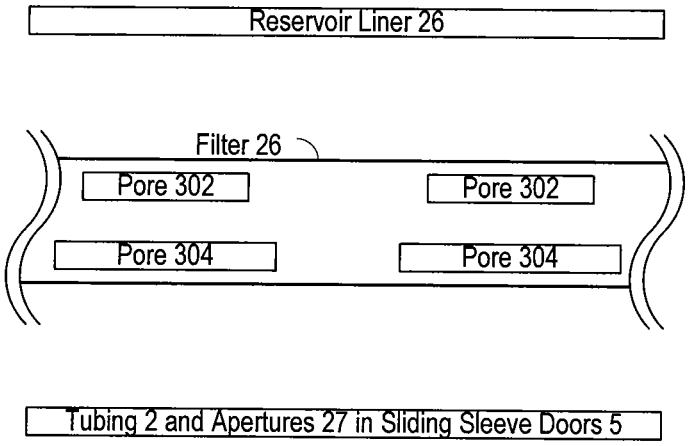
FIG. 3 illustrates a filter with pores of differing sizes in different parts of the filter.

FIG. 3 shows a filter 26 with pores of differing sizes 302, 304, in different parts of the filter. The filter 26 is manufactured such that the size of the pores 302 in the part of the filter facing a reservoir liner is smaller than the size of the pores 304 of the filter material facing the tubing and the apertures in the sliding sleeve doors. Thereby, particles small enough to enter into the filter material will also pass through the filter material. This has the advantage of minimizing the number of particles getting stuck inside the ceramic filter 26.

The invention claimed is:

1. A screen assembly for removing particulates from a fluid in a well bore, the well bore being provided with a fluid transport tubing for transport of fluids inside the fluid transport tubing, the fluid transport tubing being provided with sliding sleeve door apertures through which the fluid flows from the well bore external the fluid transport tubing and into the fluid transport tubing, the screen assembly comprising:

a supportive tube having apertures allowing well bore fluids to pass;

a filter made from a ceramic material arranged outside the fluid transport tubing and covering a section of the fluid transport tubing having the sliding sleeve door apertures, such that the filter prevents particles above a predefined size from entering through the sliding sleeve door apertures, the filter further arranged on the inside of the supportive tube, such that the filter is placed between the supportive tube and the section of the fluid transport tubing having the sliding sleeve door apertures so that the filter and the fluid transport tubing define an annular space between an inside surface of the filter that faces a center axis of the fluid transport tubing and an outside surface of the section of the fluid transport tubing having the sliding sleeve door apertures that faces the inside surface of the filter, the annular space extending between axial ends of the filter, wherein the annular space is free of obstructions.

2. A screen assembly according to claim 1, wherein the ceramic material of the filter comprises boron carbide.

3. A screen assembly according to claim 2, wherein the filter is made from sintered ceramic material.

4. A screen assembly according to claim 1, wherein the filter is made from sintered ceramic material.

5. A screen assembly according to claim 1, wherein the filter is shrinkage fitted together with the supportive tube.

6. A screen assembly according to claim 1, wherein a pore size in the part of the filter facing a reservoir liner is smaller than a pore size of the ceramic filter material facing the fluid transport tubing and the sliding sleeve door apertures such that particles small enough to enter into the ceramic filter material will also pass through the ceramic filter material.

7. A screen assembly according to claim 1, wherein the annular space provides the ceramic filter with a larger active area for flow of fluids than an active area for the flow of fluids through the sliding sleeve doors apertures.

8. A screen assembly according to claim 1, wherein a part of the filter facing the tubing and the sliding sleeve door apertures is directly exposed to the annular space.

9. A screen assembly for removing particulates from a fluid in a well bore, the well bore being provided with a fluid transport tubing for transport of fluids inside the fluid transport tubing, the fluid transport tubing being provided with sliding sleeve door apertures through which the fluid flows from the well bore external the fluid transport tubing and into the fluid transport tubing, the screen assembly comprising:

a supportive tube having apertures allowing well bore fluids to pass;

a filter made from a ceramic material arranged outside the fluid transport tubing and covering a section of the fluid transport tubing having the sliding sleeve door apertures, such that the filter prevents particles above a predefined size from entering through the sliding sleeve door apertures, the filter further arranged on the inside of the supportive tube, such that the filter is placed between the supportive tube and the section of the fluid transport tubing having the sliding sleeve door apertures so that the filter and the fluid transport tubing define an space between an inside surface of the filter that faces a center axis of the fluid transport tubing and an outside surface of the section of the fluid transport tubing having the sliding sleeve door apertures that faces the inside surface of the filter, the space extending between axial ends of the filter, wherein the space is free of obstructions.

* * * * *